US007303442B2

(12) United States Patent
Fan

(10) Patent No.: US 7,303,442 B2
(45) Date of Patent: Dec. 4, 2007

(54) CONNECTOR FOR MEMORY CARDS

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 1 day.

(21) Appl. No.: 10/998,882

(22) Filed: Nov. 29, 2004

(65) Prior Publication Data

US 2005/0124222 A1 Jun. 9, 2005

(30) Foreign Application Priority Data

Dec. 6, 2003 (CN) ..... 2003 2 0120356

(51) Int. Cl.
*H01R 24/00* (2006.01)

(52) U.S. Cl. ..... 439/630; 439/752; 439/326; 439/945

(58) Field of Classification Search ..... 439/630–632, 439/752, 79, 84, 542, 541.5, 326, 945
See application file for complete search history.

(56) References Cited

U.S. PATENT DOCUMENTS

| | | | | |
|---|---|---|---|---|
| 5,957,732 | A * | 9/1999 | Ito et al. | 439/752 |
| 6,106,340 | A * | 8/2000 | Myer et al. | 439/752 |
| 6,139,368 | A | 10/2000 | Bogese | |
| 6,352,445 | B2 | 3/2002 | Takei et al. | |
| 6,386,920 | B1 | 5/2002 | Sun | |
| 6,648,697 | B2 * | 11/2003 | Yang | 439/701 |
| 6,666,708 | B2 * | 12/2003 | Saito | 439/466 |
| 2002/0025726 | A1 | 2/2002 | Nishimura | |
| 2002/0052132 | A1 | 5/2002 | Sato | |

* cited by examiner

*Primary Examiner*—Truc Nguyen
(74) *Attorney, Agent, or Firm*—Wei Te Chung

(57) ABSTRACT

A connector (100) for receiving at least two types of memory cards differing in outer shapes and contact pad positions includes an insulative housing (1), a terminal module insert (3) fixedly assembled to the housing and a positioning member (4) detachably assembled in the housing and abutting against the insert. The housing defines a pair of positioning slots (223) and a fastener (224) formed in each positioning slot. The positioning member includes a body (41) and a pair of legs (42) interferentially engaging with the fasteners of the housing for securely holding the insert in the housing.

9 Claims, 10 Drawing Sheets

CONNECTOR FOR MEMORY CARDS

CROSS-REGERENCE TO RELATED APPLICATION

This application is related to co-pending U.S. patent applications entitled "CONNECTOR FOR MEMORY CARDS", entitled "MEMORY CARD CONNECTOR", and entitled "MEMORY CARD CONNECTOR", all of which invented by the same inventor and assigned to the common assignee as the present invention.

BACKGROUND OF THE INVENTION

1. Field of the Invention

The present invention relates to connectors and more particularly, to an electrical connector for receiving two or more cards differing in outer shapes and contact pad positions.

2. Description of the Related Art

Memory cards different in thickness as media for information have been mounted on and connected to information apparatuses through a respective connector exclusive to one particular type of the memory card among the number of the memory cards for reading information stored in the card and storing information into the card. As time goes by, the information apparatuses and hence their boards have been rapidly miniaturized, so that areas occupied by the boards have been limited. What is worse, a plurality of connectors increase the volume of the information apparatuses, which are incompatible with the miniaturization and in no way suitable for portable apparatus. In recent years, the information apparatuses such as portable telephones, telephones, personal digital assistants (PDAs), cameras and the like, various functional expansions are achieved by mounting memory cards such as SIM (subscriber identify module) card, MMC (multimedia card), SD (super density, secure digital) card, memory stick (trademark) and the like, which are incorporated as memories or the like to enhance the convenience while in use. U.S. Pat. No. 6,386,920 issued to Sun on May 14, 2002 discloses a joint socket device for different types of memory cards. The Sun device comprises a lower base and an upper cover being joined to the lower base so as to form a first chamber for containing a SMC, a second chamber for containing a MMC, a third chamber for containing a SD and a forth chamber for containing a MS. The lower base has a conduction part being included in the first chamber, the second chamber, the third chamber and the forth chamber. A plurality of conductive terminals are disposed at the conduction part of the lower base. Each terminal has a contact portion for engaging with a contact pad formed on corresponding SMC, MMC, SD or MS and a solder portion for soldering to a printed circuit board. Hence, the memory cards are electrically connected through the terminals for performing an operation of read or write.

However, being fixed in the lower base, the terminals are difficult to assemble thereto and remove therefrom. It is a complicated and bothering process. That means it is better not to rework or repair on them even though some of them need to be changed.

Hence, an improved connector for memory cards is needed to overcome the foregoing shortcomings.

BRIEF SUMMARY OF THE INVENTION

It is an object of the present invention to provide a connector which is capable of receiving two or more types of card differing in outer shapes or contact pad positions.

Another object of the present invention is to provide a compact connector and servicing work and the like can be conveniently carried out, and the connector has a long cycle life.

To fulfill the above-mentioned objects, according to a preferred embodiment of the present invention, a connector adapted for containing at least two types of memory cards differing in outer shape and contact pad position an insulative housing, a terminal module insert fixedly assembled to the housing and a positioning member detachably assembled in the housing and abutting against the insert. The housing defines a pair of positioning slots, a fastener formed in each positioning slot. The insert includes an insulative casing having an upper plate, a lower plate and an upright plate. The upper plate parallel to the lower plate and the upright plate locates between rear edges of the upper and lower plate to define a common receiving space for receiving the different types of cards. A plurality of terminals fixed in the casing for mating with some of the cards. The terminals include fixing portions running through the upper, upright and lower plate respectively, contacting portions forwardly projecting for electrically engaging with contact pads of corresponding cards and mounting portions rearwardly projecting beyond the outlets and to be fixed between adjacent partitions for being soldered to the printed circuit board. The positioning member includes a body and a pair of legs interferentially engaging with the fastener of the housing for securely holding the insert in the housing.

Because the connector for memory cards employs the insert which is capable of receiving two or more types of terminals and the positioning member ensuring the insert in the housing without defining too many terminal-receiving passageways in the housing and without worrying about the insert misplacement, thereby reliably retaining the terminals in position and ensuring interconnection between the terminals and the cards.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
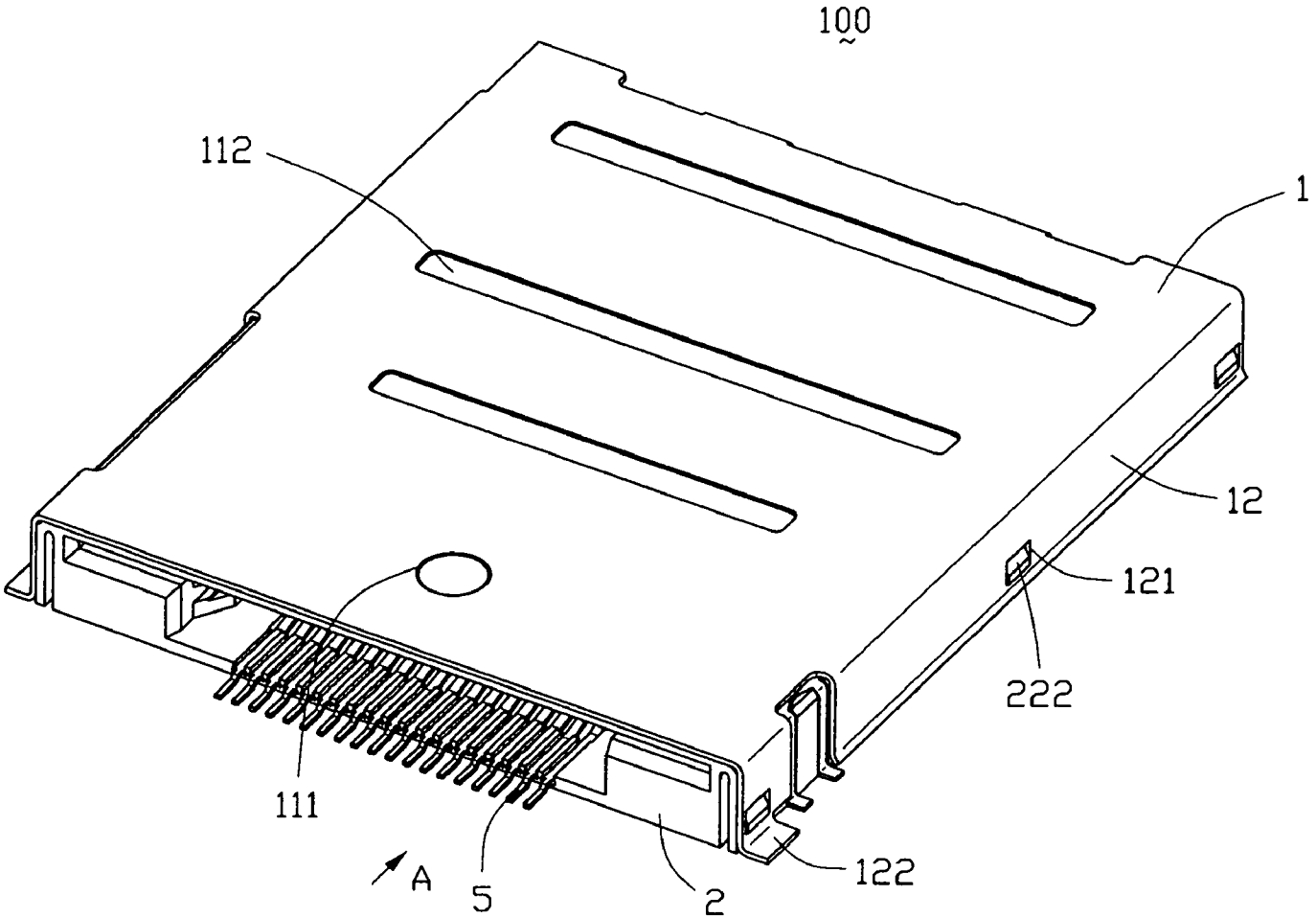
FIG. 1 is a perspective view of a connector for memory cards according to the present invention.
Figure 2:
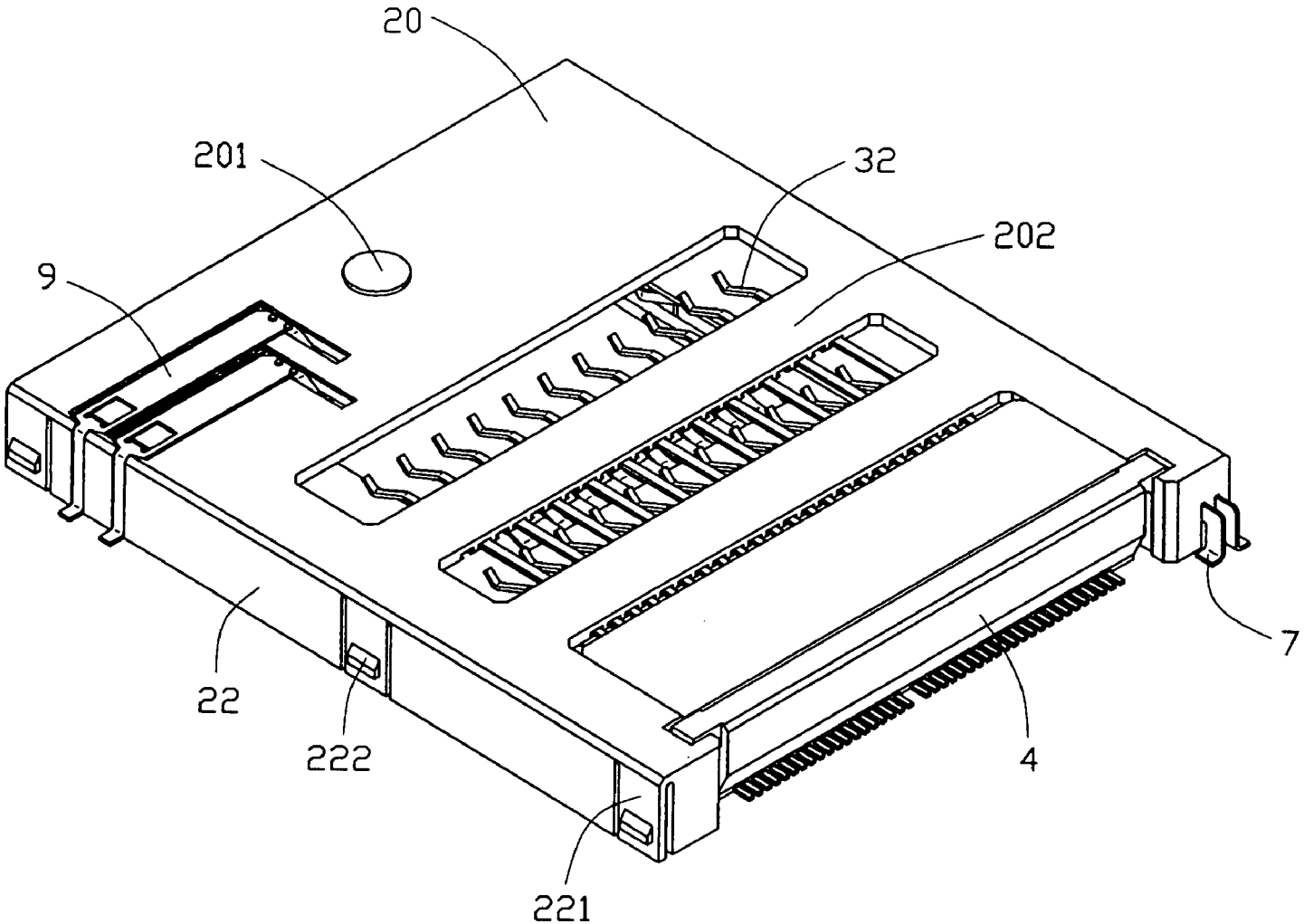
FIG. 2 is a perspective view of the connector, wherein a shield is taken away for clarify.
Figure 3:
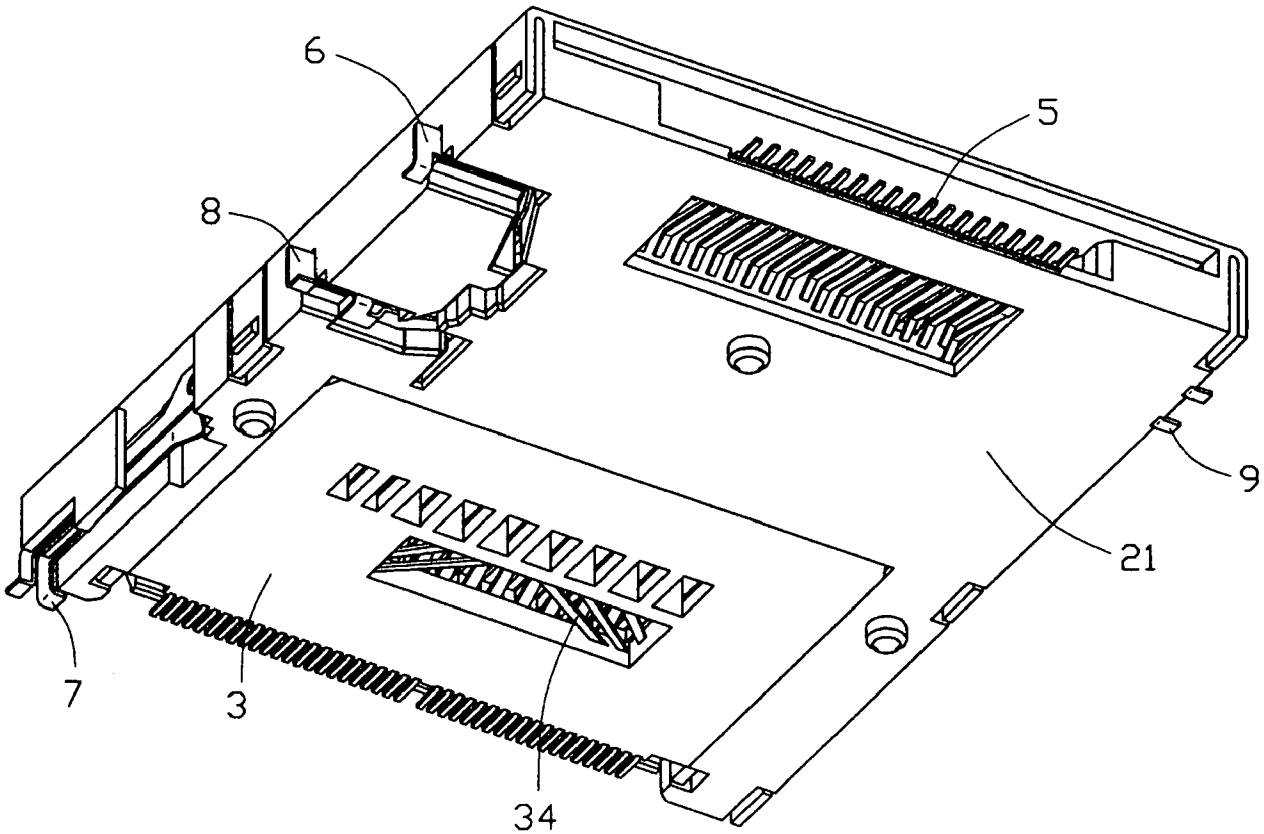
FIG. 3 is a perspective view of the connector, but taken a bottom view.

Referring to FIG. 1, in the present embodiment, a connector 100 is possible for being alternatively inserted with a Smart Media (SM) card, a Memory Stick (MS) card, a Secure Digital (SD) or a Multi Media (MMC) card and a xD-picture card.

Certain terminology may be used in the following description for convenience only and is not considered to be limiting. The words "upper", "lower", "front" and "rear", "forwardly", "rearwardly", "upwardly" and "downwardly" make reference to arrow A (shown in FIG. 1) hereinafter, that is insert direction of the memory cards.

Referring to the drawings in greater detail, and first to FIGS. 1-5, a connector 100 according to the present invention comprises a shield 1, an insulative housing 2 enclosed by the shield 1, a terminal module insert 3 embedded within the housing 2 and a positioning member 4 detachably assembled in the housing 2 for securing the insert 3 in the housing 2.

The shield 1 is of a substantially rectangular-shaped configuration and includes a top cover 11, a pair of lateral plates 12 downwardly extending from opposite sides of the top cover 11 and a pair of tabs 13 downwardly extending from a rear end of the top cover 11 to define a stop surface (not labeled) thereof. The top cover 11 defines a round hole 111 at a front portion thereof and defines a plurality of depressions 112 well-proportioned behind the round hole 111. Each lateral plate 12 defines a plurality of holes 121 and comprises a plurality of flanges 122 extending outwardly and transversely therefrom for soldering to a printed circuit board (PCB, not shown).

The housing 2 includes a top wall 20, a bottom wall 21 and opposite side walls 22. The top, bottom and side walls together define a receptacle (not labeled) therebetween. The top wall 20 forms a protrusion 201 on a front portion thereof for mating with the round hole 111 of the shield 1. A plurality of top cutouts (not labeled) are defined behind the protrusion 201 of the top wall 20 so as to form a pair of crossrails 202 transversely therebetween. Each crossrail 202 has a lower face defining a plurality of SM passageways 203. The bottom wall 21 is parallel to the top wall 20 and is generally a half in lengthwise relative to the top wall 20. The bottom wall 21 defines a bottom cutout (not labeled) at a rear portion thereof. A plurality of xD-picture passageways 211 are defined in the front portion of the bottom wall 21 and communicate with a front margin of the cutout. A plurality of SD/MMC passageways 212 are defined at a rear portion of the bottom wall 21. At an outer surface of the bottom wall 21, a plurality of mounting posts 213 depend perpendicularly to insert into complementary mounting holes in the PCB, thereby mounting the connector 100 to the PCB. The side walls 22 are formed between the top and the bottom wall 20, 21. The side walls 22 form a plurality of flaps 221. Each flap 221 forms an embossments 222 projecting outwardly therefrom for engaging with the holes 121 of the shield 1. A pair of positioning slots 223 are defined in inner rear edges of the side walls 22 and each form a downwardly extending fastener 224 therein. A support beam 23 inwardly and longitudinally projects from a lower portion of an inner surface of a corresponding side wall 22. A pair of guiding stems 225 are symmetrically formed at the inner surfaces of side walls 22 and are positioned under the support beams 23.

Referring to FIGS. 6-9, the insert 3 comprises an insulative casing 31 and a plurality of first, second, and third conductive terminals 32, 33, 34 mounted in the casing 31. In the embodiment of the present invention, the first, second, and third terminals 32, 33, 34 are integral molded with the casing and the first, second, and third terminals 32, 33, 34 mate with the SM card, the MS card and the SD/MMC card, respectively. For conveniently, SM terminals 32, MS terminals 33 and SD/MMC terminals 34 will cover for the first, second and third terminals 32, 33 and 34 respectively hereinafter. The casing 31 includes an upper plate 311, a lower plate 312 and an upright plate 313 therebetween. The upper, lower and upright plate 311, 312 and 313 cooperatively defines a receiving space 314 therebetween. The upper plate 311 is parallel to the lower plate 312 and is shorter than the lower plate 312. The lower plate 312 symmetrically defines a pair of guiding slots 315 horizontally running through opposite sides thereof for engaging with the guiding stems 225 of the housing 2. The upright plate 313 locates between rear edges of the lower and upper plates 312, 311. A plurality of terminal outlets 316 arranged in an upper row and a lower row are defined at upper and lower portions of the upright plate 313 respectively. Corresponding the outlets 316, a plurality of parallel partitions 317 are rearwardly formed at the upright plate 313 and stand therebeside.

Figure 9:
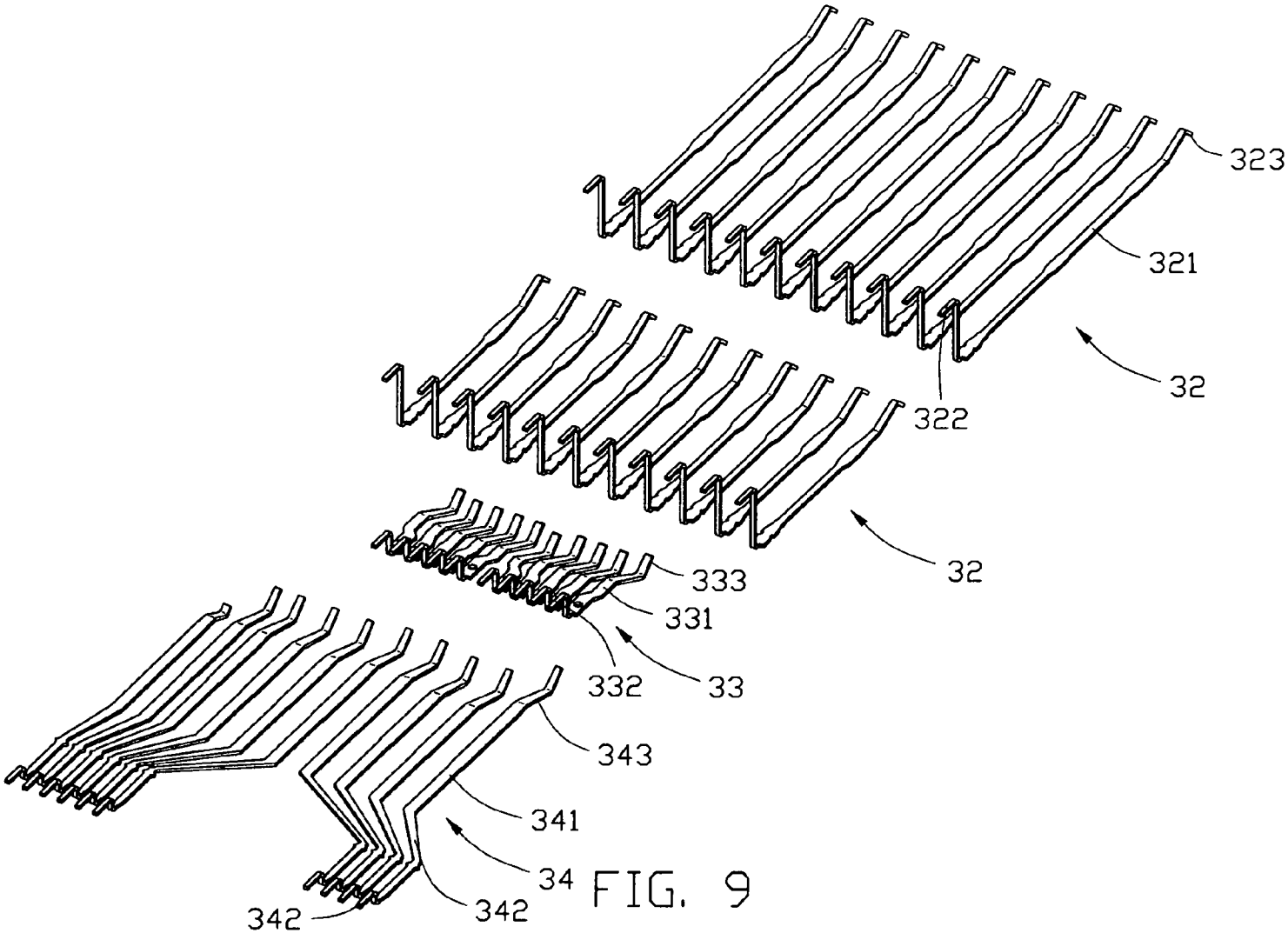
FIG. 9 is a perspective view of three types of terminals of the insert.
Figure 10:
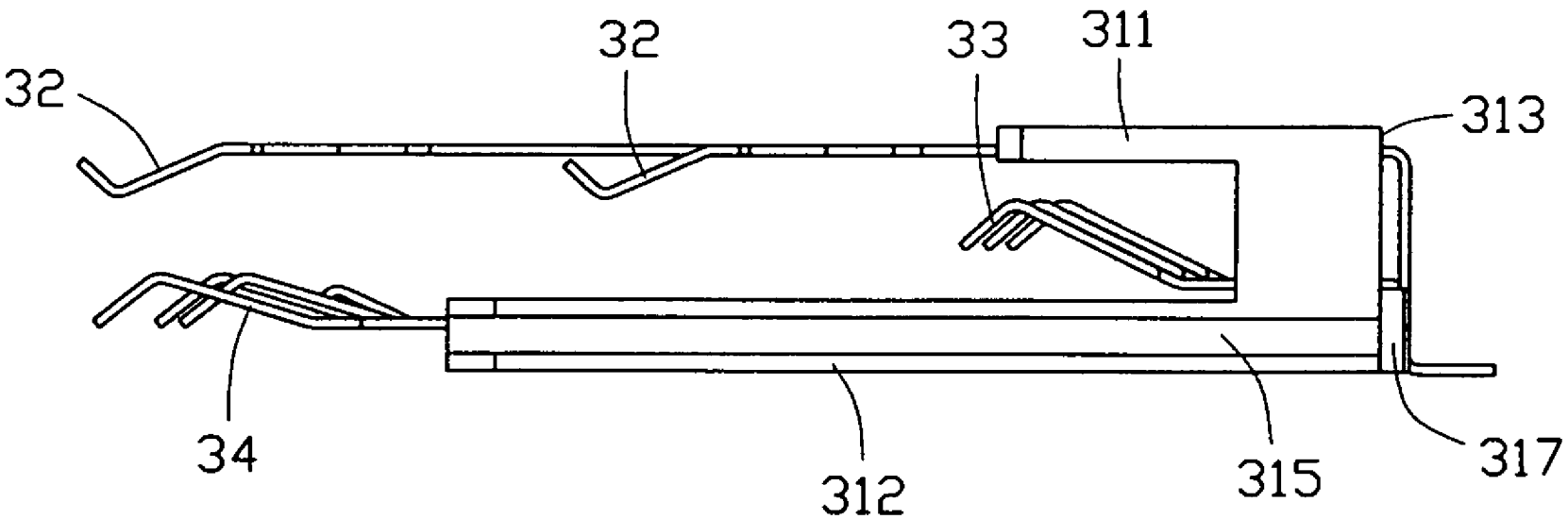
FIG. 10 is a side view of insert for clarifying the position state of the three types terminals.

As most clearly seen in FIGS. 9 and 10, the SM terminals 32 include two types of long and short terminals, so that the short terminals are disposed between arrangement pitches of the long ones as two alternating rows. The MS terminals 33 have configurations similar to those SM terminals 32, but are still shorter than the short ones of the SM terminals 32. The SD/MMC terminals 34 are different from the SM and the MS terminals 32, 33 substantially at the front portions thereof. In the present embodiment, the SD/MMC terminals 34 are ten and dispart as two parts, that is six in left and four in right. The two parts of the third terminals 34 flex outwardly each other and set a vacant region for fitly retaining the second terminals 33. Through figures of the SM, MS and SD/MMC terminals 32, 33 and 34 different from each other, functions are similar. Each SM, MS and SD/MMC terminal 32, 33, 34 respectively includes a generally flat fixing portion 321, 331, 341 to be fixed to the housing 2, a generally L-shaped mounting portion 322, 332, 342 downwardly extending from a rear end of the fixing portion 321, 331, 341 adapted to connect the PCB and a generally V-shaped contacting portion 323, 333, 343 projecting from opposite front end of the fixing portion 321, 331, 341 adapted to contact the contact pads of the corresponding cards. Especially, the contacting portions 323 of the SM terminals 32 are project downwardly, but those of the MS and SD/MMC terminals 33, 34 project upwardly.

Figure 4:
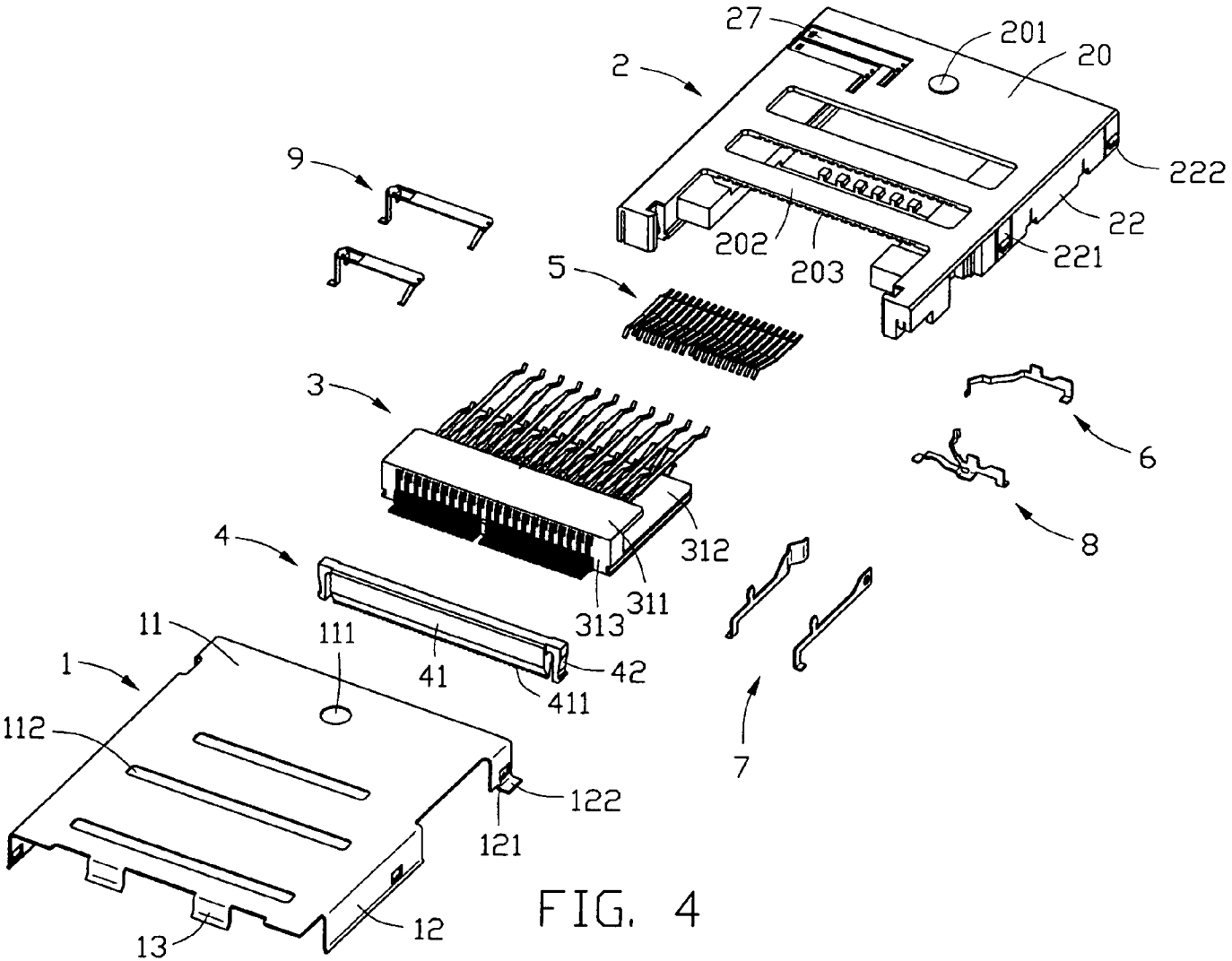
FIG. 4 is an exploded view of the connector.
Figure 5:
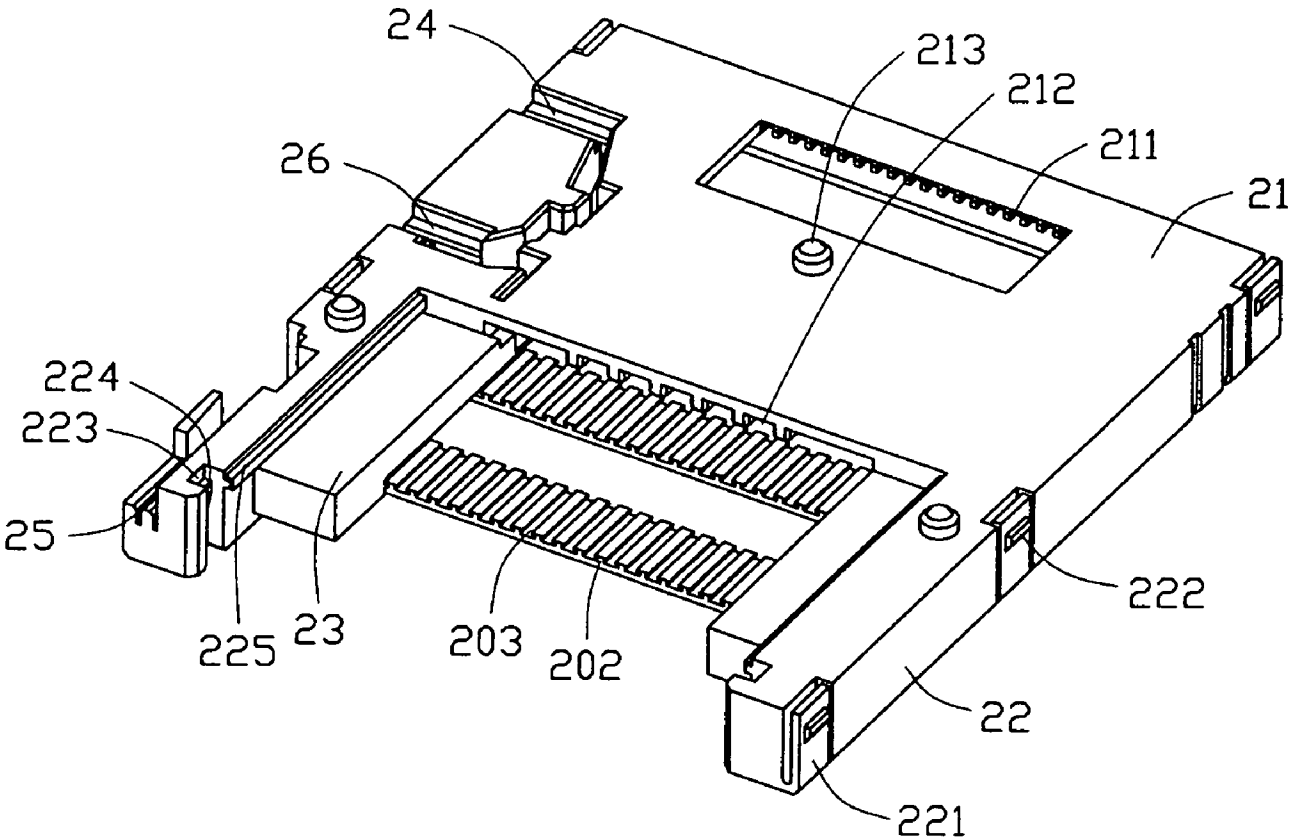
FIG. 5 is a perspective view of an insulative housing of the connector as shown in FIG. 4.

Referring to FIG. 4, the positioning member 4 is of a generally rectangle configuration and is provided for holding the insert 3 in the housing 2. The positioning member 4 includes a body 41 and a pair of legs 42 symmetrically extending downwardly from opposite sides of the body 41. The body 41 defines a plurality of recesses 411 at a bottom edge thereof for receiving the mounting portions 322, 332 and 342 of the SM, MS and SD/MMC terminals 32, 33 and 34. The legs 42 are inserted into the positioning slots 223 of the housing 2 to interferentially engage with the fastener 224 for securely retaining the positioning member 4 in position, thereby securely retaining the insert 3 in the housing 2.

The connector 100 is provided further with a plurality of forth terminals 5 mounted in the xD-picture slots 211 of the housing 2. In the embodiment of the present invention, the forth terminals 5 engage with contact pads of an xD-picture card. More, as best seen in FIG. 4 and with referring to FIGS. 2 and 3, a grounding terminal 6, a pair of switch terminals 7, a written terminal 8 and a pair of written protection terminals 9 are provided to respectively received in a grounding terminal recess 24, a pair of switch terminals recesses 25, a written terminal recess 26 and a pair of written protection terminal recesses 27 of the housing 2. The structure and functions of the grounding terminal 6, switch terminals 7, written terminal 8 and written protection terminals 9 and corresponding recess 24, 25, 26 and 27 are well know to these skilled in the art, thereby a detailed description is omitted hereinafter.

Figure 6:
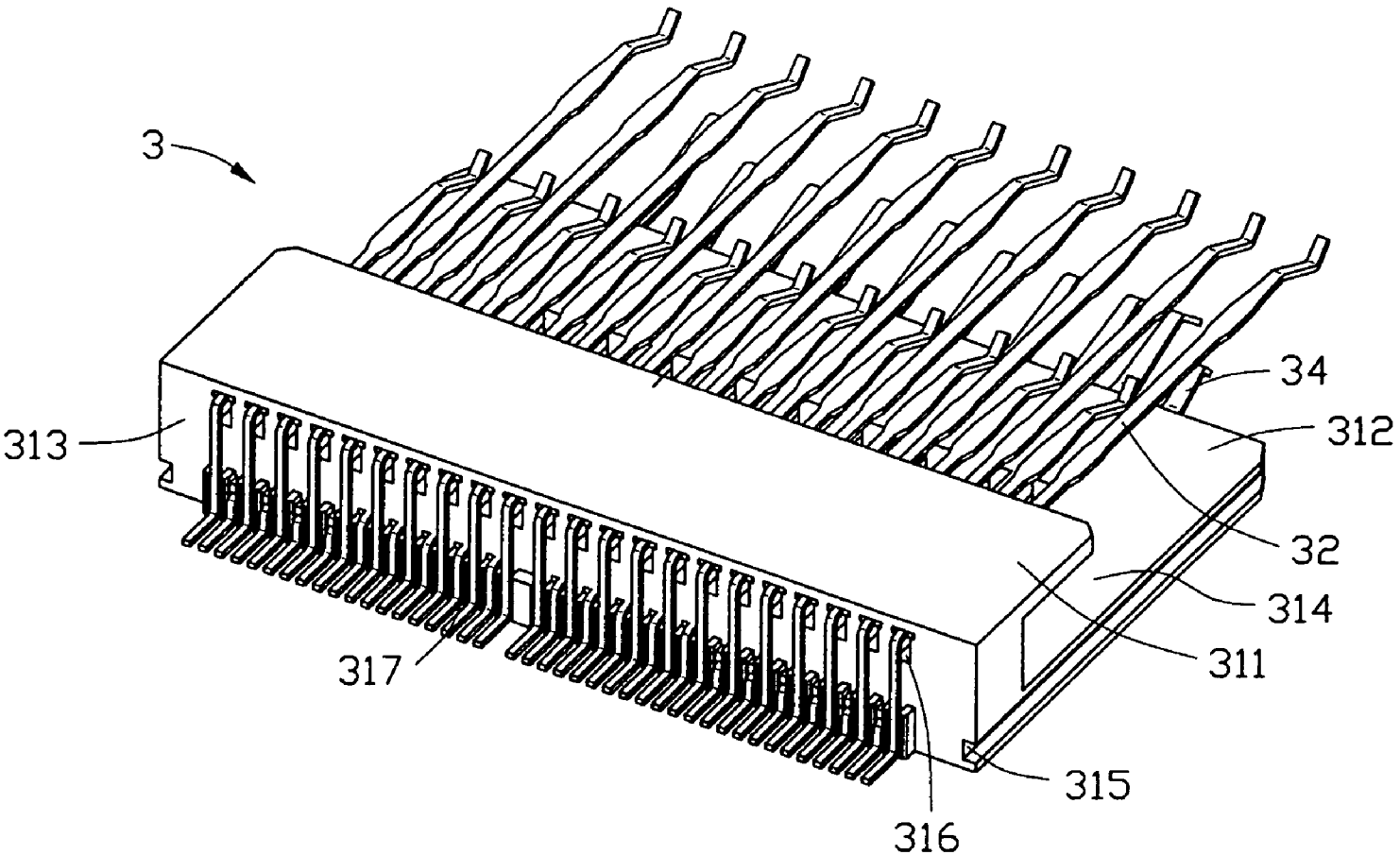
FIG. 6 is a perspective view of a terminal module insert of the connector.
Figure 7:
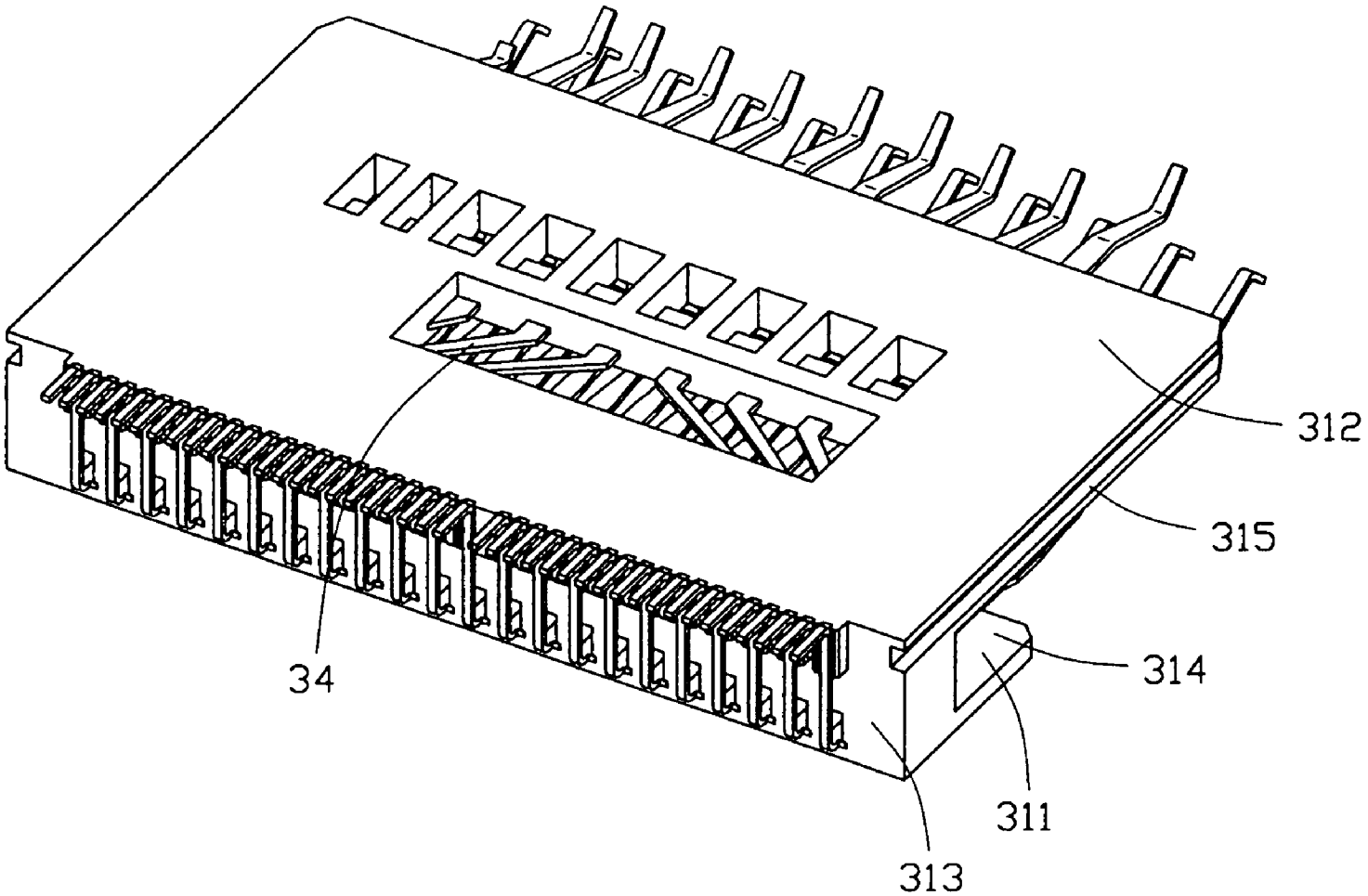
FIG. 7 is a perspective view of the insert similar to FIG. 6, but taken from another point.
Figure 8:
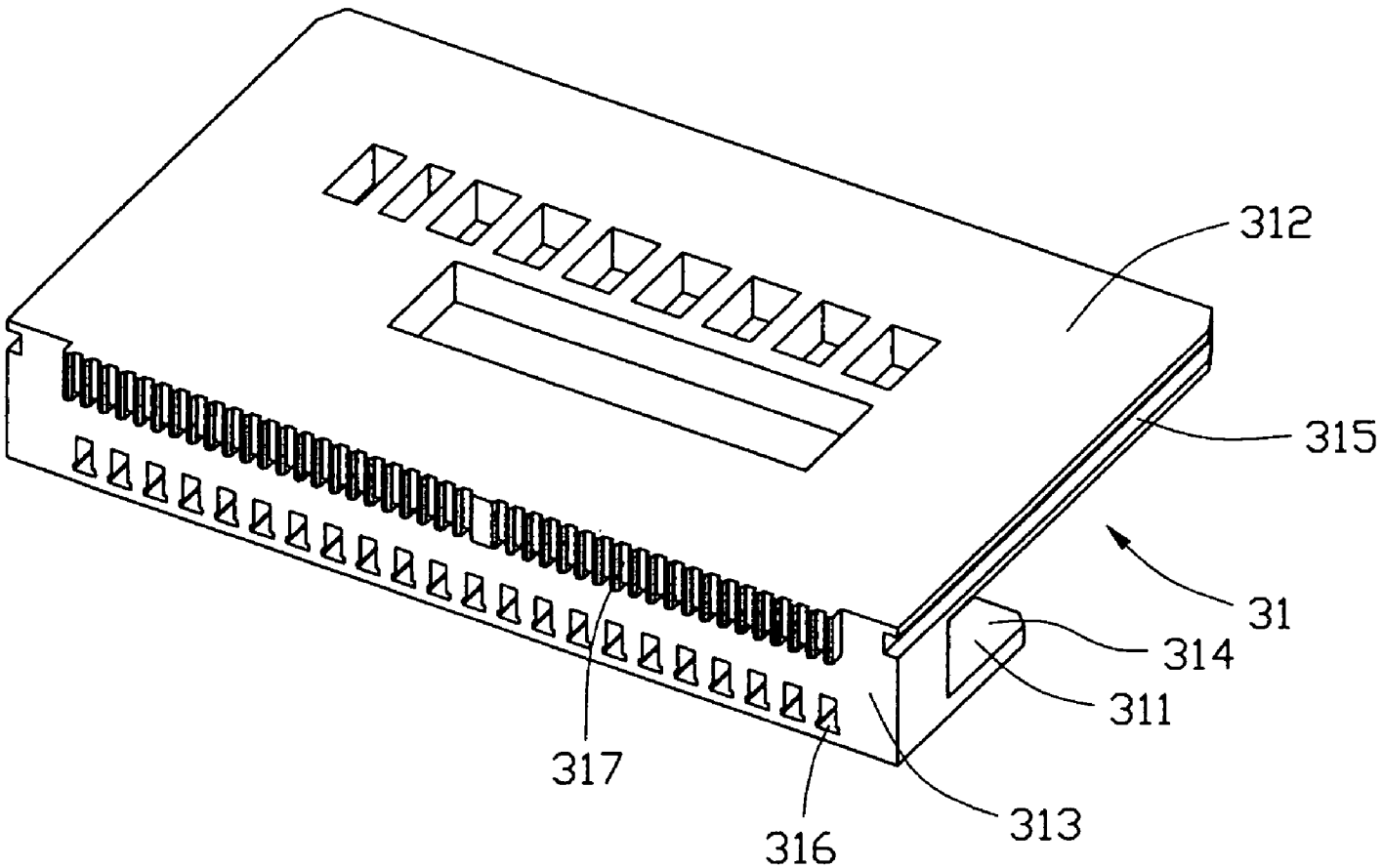
FIG. 8 is a perspective view of an insulative casing of the insert, as shown in FIGS. 6 and 7.

Referring to the drawings in great detail, and first, particularly in FIG. 6 and FIG. 10, the SM, MS and SD/MMC terminals 32, 33, 34 are integral molded with the casing 31. The fixing portions 321, 331 and 341 of the long and short SM terminals 32, the MS and SD/MMC terminals 33, 34 generally parallel to the upper or lower plate 32 of the casing 31 and alternatively and respectively run through the upper, upright and lower plates 311, 313, 312. The contacting portions 323, 333, 343 of the SM, MS and SD/MMC terminals 32, 33, 34 forwardly extend to locate at appropriate locations and are appropriately curved toward which the cards are inserted into the connector 100, whereby the card can be smoothly inserted into the connector 100 without any jamming and buckling. The mounting portions 322, 332, 342 of the SM, MS and SD/MMC terminals 32, 33, 34 are fixed between corresponding pairs of partitions 317 of the insert 3 and extend beyond the partitions for soldering to the PCB. Secondly, the xD-picture terminals are received in the xD-picture passageways 211, the insert 3 fixedly assembled into the housing 2, particularly in FIGS. 2 and 3. The insert 3 is seated in the bottom cutout of the housing 2 with the guiding stems 225 of the housing 2 engaging with the guiding slots 315 of the insert 3. The fixing portions 321 of the short and long SM terminals 34 are snugly received in the SM passageways 203 of the crossrails 202 of the housing 2. The support beams 23 of the housing 2 project into the receiving space 314 of the insert 3 with front faces abutting against sides of inner surface of the upright plate 313 of the insert 3. Then, the positioning member 4 is detachedly assembled to housing 2. The body 41 of the positioning member 4 closes to the upright plate 213 of the insert 3. The legs 42 insert into the positioning slots 223 and interferentially engage with the fasteners 224 of the housing 2 for securely fastening the positioning member 4 to the housing 2, whereby securely retaining the insert 3 in position. The recesses 411 of the positioning member 4 receive horizontal section of the mounting portions 322, 332 and 342 of the MS, SM and SD/MMC terminals 32, 33 and 34. Then, the grounding terminal 6, switch terminals 7, the written terminal 8 and the written protection terminals 9 are received respectively in the grounding terminal recess 24, the switch terminals recesses 25, the written terminal recess 26 and the written protection terminal recesses 27 of the housing 2. Lastly, the shield 1 is assembled to the housing 2, whereby the tabs 13 resist the positioning member 4 and the embossments 222 of the flap 221 of the housing 2 engage with corresponding holes 121 of the shield 1.

As described above, the insert 3 is separated from the housing and assembled with the housing afterwardly, so the structure of the MS, SM and SD/MMC terminals 31, 32 and 33 of the insert 3 do not affect the housing 2 and the service working can be conveniently carried out. More, the connector 100 employs the positioning member 4 and the pair of support beams 23 of the housing 2 efficiently guiding the insert 3 in the position where the MS, SM and SD/MMC cards are brought into electrical connection with the MS, SM and SD/MMC terminals 31, 32 and 33 of the insert 3.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector adapted for receiving different types of memory cards, comprising:

an insulating housing including a top wall, a bottom wall and opposite side walls, the top, bottom and side walls together defining a receptacle therebetween, each side wall defining a positioning slot and a fastener formed in the positioning slot; and a terminal module insert fixedly assembled in the receptacle, the insert including an insulative casing and a plurality of terminals fixed in the casing, the casing including an upper, a lower and an upright plates, the upper plate parallel to the lower plate and the upright plate located between rear edges of the upper and lower plates to define a common receiving space for receiving the different types of cards; and a positioning member detachably assembled in the housing and abutting against the insert, the positioning member including a body and a pair of legs interferentially engaging with the fastener of the housing for securely holding the insert in the housing.

2. The connector according to claim 1, wherein the bottom wall is parallel to the top wall and shorter in length than the top wall so as to define a cutout thereat, the lower plate of the insert being located at the cutout with the upper plate of the insert adjacent to the top wall of the housing.

3. The according to claim 2, wherein a pair of guiding stems are formed on the side walls of the housing, and wherein the lower plate of the casing defines a pair of guiding slots at opposite sides thereof, the guiding stems engaging with the guiding slots for guiding the insert into the housing.

4. The connector according to claim 1, wherein the side walls of the housing form a pair of support beams inserting into the receiving space of the insert for securing the insert in the housing.

5. The connector according to claim 4, wherein the terminals of the insert include fixing portions, contacting portions and mounting portions, the fixing portions running through the upper, upright and lower plates of the casing respectively, the contacting portions forwardly projecting for electrically engaging with contacting pads of corresponding cards, the mounting portions rearwardly projecting beyond the casing for being soldered to the printed circuit board.

6. The connector according to claim 1, wherein the upright plate forms a plurality of partitions, the mounting portions of the terminals fixed between adjacent partitions.

7. The connector according to claim 1, wherein the positioning member defines a plurality of recesses, the mounting portions of the terminals running through the recesses for being soldered to the printed circuit board.

8. The connector according to claim 1, wherein the connector comprises a shield assembled to the housing, the shield including a top cover and a pair of lateral plates extending from opposite sides of the top cover.

9. The electrical card connector according to claim 8, wherein each lateral plate defines a hole, and wherein each side wall of the housing has a flap, each flap forming an embossment thereon for engaging with a corresponding hole of the shield.

* * * * *